US011014726B2

(12) United States Patent
Peeler et al.

(10) Patent No.: US 11,014,726 B2
(45) Date of Patent: May 25, 2021

(54) CARTON AND CARTON BLANK

(71) Applicant: WestRock Packaging Systems, LLC, Atlanta, GA (US)

(72) Inventors: Andrew T. Peeler, Richmond, VA (US); Matthew E. Zacherle, Chesterfield, VA (US); Bradford J. Walling, Chesterfield, VA (US)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 0 days.

(21) Appl. No.: 16/614,420

(22) PCT Filed: May 14, 2018

(86) PCT No.: PCT/US2018/032498
§ 371 (c)(1),
(2) Date: Nov. 18, 2019

(87) PCT Pub. No.: WO2018/213158
PCT Pub. Date: Nov. 22, 2018

(65) Prior Publication Data

US 2020/0172310 A1 Jun. 4, 2020

Related U.S. Application Data

(60) Provisional application No. 62/508,973, filed on May 19, 2017.

(51) Int. Cl.
*B65D 71/36* (2006.01)

(52) U.S. Cl.
CPC ..... *B65D 71/36* (2013.01); *B65D 2571/0045* (2013.01); *B65D 2571/0066* (2013.01)

(58) Field of Classification Search
CPC ..... B65D 71/36; B65D 2571/00469; B65D 2571/00839; B65D 2571/00444; B65D 2571/00537; B65D 5/541
(Continued)

(56) References Cited

U.S. PATENT DOCUMENTS 3,904,036 A 9/1975 Forrer
5,246,113 A * 9/1993 Schuster ..... B65D 71/36 206/430
(Continued)

FOREIGN PATENT DOCUMENTS

CL 200001601 5/2001
CL 200001874 10/2001
(Continued)

OTHER PUBLICATIONS

International Search Report from PCT/US18/32498 dated Sep. 13, 2018.
(Continued)

*Primary Examiner* — Christopher R Demeree
(74) *Attorney, Agent, or Firm* — Brian J. Goldberg; Neil G. Cohen

(57) ABSTRACT

Aspects of the disclosure relate to a carton (90) for packaging one or more articles(IO) and to a blank (10) for forming the carton. The carton comprises a plurality of panels (12,14,16,18,20,22) for forming walls of the carton including: a top wall, a bottom wall, a pair of side walls and a pair of end walls. The top wall (14,22) comprises a handle structure (H). The handle structure comprises at least one hand aperture (A1,A2) defined in the top wall. At least one primary fold line (39*a*,39*b*,49*a*,49*b*) is formed in the top wall and extends from a region of the at least one hand aperture towards at least one of the corners of the top wall. A diagonal severance line (47*a*, 47*b*, 57*a*, 57*b*) is formed in the top wall inwardly of and spaced from the at least one corner for separating the at least one primary fold line from the at least one corner.

20 Claims, 5 Drawing Sheets

(58) Field of Classification Search
USPC .... 229/117.13, 117.14, 920, 117.12, 117.26; 206/427, 141, 428
See application file for complete search history.

(56) References Cited

U.S. PATENT DOCUMENTS

| | | | | |
|---|---|---|---|---|
| 5,297,725 | A * | 3/1994 | Sutherland | B65D 71/36 229/117.13 |
| 5,307,932 | A | 5/1994 | Stout et al. | |
| 5,379,944 | A | 1/1995 | Stout et al. | |
| 5,385,234 | A | 1/1995 | Stout et al. | |
| 5,480,091 | A | 1/1996 | Stout | |
| 5,482,203 | A | 1/1996 | Stout | |
| 5,738,273 | A * | 4/1998 | Auclair | B65D 5/46192 229/117.13 |
| 5,826,782 | A | 10/1998 | Stout | |
| 5,906,313 | A | 5/1999 | Oliff | |
| 6,425,520 | B1 | 7/2002 | Peterson | |
| 8,181,782 | B2 | 5/2012 | Harrelson | |
| 9,592,942 | B2 | 3/2017 | Walling | |
| 2016/0159516 | A1* | 6/2016 | Ball | B65D 5/16 229/117.13 |
| 2016/0229611 | A1* | 8/2016 | Walling | B65D 71/36 |

FOREIGN PATENT DOCUMENTS

| | | | |
|---|---|---|---|
| CL | 200101046 | | 3/2002 |
| CL | 200803891 | | 4/2010 |
| CL | 201602834 | | 4/2017 |
| EP | 0713470 | B1 | 5/1996 |
| WO | 96/38348 | A1 | 12/1996 |
| WO | WO 96/38348 | A1 | 12/1996 |
| WO | 2015/038748 | A1 | 3/2015 |
| WO | WO2015038748 | A1 | 3/2015 |

OTHER PUBLICATIONS

Search Report (Office Action) issued in corresponding Chilean Patent Application No. CL 201903276, dated Oct. 7, 2020.

* cited by examiner

CARTON AND CARTON BLANK

CROSS-REFERENCE TO RELATED APPLICATIONS

This application is a National Phase application of PCT Application PCT/US18/32498, filed May 14, 2018, which claims the benefit of U.S. Provisional Patent Application No. 62/508,973, filed May 19, 2017, which are incorporated herein by reference in their entirety.

TECHNICAL FIELD

The present invention relates to a carton and to a blank for forming the carton. More specifically, but not exclusively, the invention relates to a carton having a carrying handle for carrying the carton.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carton with a carrying handle for transportation by a consumer.

The present invention seeks to overcome or at least mitigate the problems of the prior art.

SUMMARY

According to a first aspect of the present disclosure there is provided a carton for receiving a plurality of articles, the carton comprising a plurality of panels for forming walls of the carton including; a top wall, a bottom wall, a pair of side walls; and a pair of end walls. The top wall has opposed side edges and opposed end edges. The top wall comprises a handle structure. The handle structure comprises at least one hand aperture defined in the top wall. The handle structure may also comprise at least one primary fold line formed in the top wall and may extend from an end region of the at least one hand aperture toward at least one of the corners of the top wall. A diagonal severance line may be formed in the top wall inwardly of and spaced from the at least one corner for separating the at least one primary fold line from the at least one corner. A first branch fold line may extend from an intermediate point along the length of the at least one primary fold line and may extend toward one of an adjacent end wall and an adjacent side wall.

Optionally, the first branch fold line and the at least one primary fold line define a first angle therebetween.

Optionally, the handle structure comprises:

a second branch fold line extending from an intermediate point along the length of the at least one primary fold line and extending toward the other one of an adjacent end wall and an adjacent side wall.

Optionally, the second branch fold line and the at least one primary fold line define a second angle therebetween.

Optionally, the second angle is different to the first angle.

Optionally, the second angle is greater than the first angle.

Optionally, the second angle is less than the first angle.

Optionally, the first branch line and the diagonal severance line converge at a hinged connection between the top wall and said one of an adjacent end wall and an adjacent side wall.

Optionally, the second branch line and the diagonal severance line converge at a hinged connection between the top wall and said other one of an adjacent end wall and an adjacent side wall.

Optionally, the at least one primary fold is at least 50% longer in length than the first branch line.

Optionally, the at least one primary fold is at least 50% longer in length than the second branch line.

Optionally, the at least one primary fold is at least twice the length of the first branch line.

Optionally, the at least one primary fold is at least twice the length of the second branch line.

According to a second aspect of the present disclosure there is provided a carton for receiving a plurality of generally cylindrical articles. The carton comprises a plurality of panels for forming walls of the carton including; at least one top panel for forming a top wall, at least one base panel for forming a base wall, a first side panel for forming a first side wall and a first end closure panel for forming an end wall. The first side panel may be hingedly connected to the at least one top panel by a first fold line. The first end closure panel may be hingedly connected to the at least one top panel by a second fold line. The top wall is adapted to be placed over the plurality of generally cylindrical articles such that the top wall is disposed generally perpendicularly to the cylindrical axes of the articles. The top wall may have opposed side edges and opposed end edges. The top wall comprises a handle structure. The handle structure comprises at least one handle opening defined in the top wall. At least one primary fold line may be formed in the top wall and may extend from an end region of the at least one handle opening toward at least one of the corners of the top wall. A diagonal severance line may be formed in the top wall inwardly of and spaced from the at least one corner for separating the at least one primary fold line from the at least one corner. The diagonal severance line may intersect with at least one of first and second fold lines to form at least one intersection. The distance between the at least one intersection and the at least one corner may be in the range given by the following formula:

$$\frac{Dc(\sqrt{2}-1)}{\sqrt{2}} < D \leq Dc$$

where $D_C$ is a diameter of each cylindrical article.

Optionally, the diagonal severance line intersects with both the first and second fold lines to form first and second intersections, wherein the distance D between each intersection and the at least one corner is given by the following formula:

$$\frac{Dc(\sqrt{2}-1)}{\sqrt{2}} < D \leq Dc$$

where $D_C$ is a diameter of each cylindrical article.

Optionally, the angle defined between the second fold line and the severance line is greater than 16 degrees and less than 74 degrees.

According to a third aspect of the present disclosure there is provided a carton for receiving a plurality of generally cylindrical articles. The carton comprises a plurality of panels for forming walls of the carton including; at least one top panel for forming a top wall, at least one base panel for forming a base wall, a first side panel for forming a first side wall and a first end closure panel for forming an end wall. The first side panel may be hingedly connected to the at least one top panel by a first fold line. The first end closure panel may be hingedly connected to the at least one top panel by a second fold line. The top wall is adapted to be placed over the plurality of generally cylindrical articles such that the top wall is disposed generally perpendicularly to the cylindrical axes of the articles. The top wall may have opposed side edges and opposed end edges. The top wall comprises a handle structure. The handle structure comprises at least one handle opening defined in the top wall. At least one primary fold line may be formed in the top wall and may extend from a region proximate the at least one handle opening toward at least one of the corners of the top wall. A diagonal severance line may be formed in the top wall inwardly of and spaced from the at least one corner for separating the at least one primary fold line from the at least one corner. The diagonal severance line may intersect with at least one of first and second fold lines to form at least one intersection. The distance D between the at least one intersection and the at least one corner may be in the range given by the following formula:

$$\frac{Dc}{2} \leq D \leq Dc$$

where $D_C$ is a diameter of each cylindrical article.

According to a fourth aspect of the present disclosure there is provided a carton for receiving a plurality of generally cylindrical articles. The carton comprises a plurality of panels for forming walls of the carton including; at least one top panel for forming a top wall, at least one base panel for forming a base wall, a first side panel for forming a first side wall and a first end closure panel for forming an end wall. The first side panel may be hingedly connected to the at least one top panel by a first fold line. The first end closure panel may be hingedly connected to the at least one top panel by a second fold line. The top wall is adapted to be placed over the plurality of generally cylindrical articles such that the top wall is disposed generally perpendicularly to the cylindrical axes of the articles. The top wall may have opposed side edges and opposed end edges. The top wall comprises a handle structure. The handle structure comprises at least one handle opening defined in the top wall. At least one primary fold line may be formed in the top wall and may extend from a region proximate the at least one hand aperture toward at least one of the corners of the top wall. A diagonal severance line may be formed in the top wall inwardly of and spaced from the at least one corner for separating the at least one primary fold line from the at least one corner. The diagonal severance line may intersect with at least one of first and second fold lines to form at least one intersection. The distance D between the at least one intersection and the at least one corner may be given by the following formula:

$$D=Dc+D0$$

where $D_C$ is a diameter of each cylindrical article and D0 is an offset distance.

Optionally, the offset distance D0 is in the range given by the formula:

$$0.07 \leq \frac{D0}{Dc} \leq 0.13$$

Optionally, the offset distance D0 is 0.25 inches (6.4 mm).

Optionally, the offset distance D0 is less than or equal to 0.25 inches (6.4 mm).

According to a fifth aspect of the present disclosure there is provided a blank for forming a carton, the blank comprising a plurality of panels for forming walls of the carton, the blank including:

at least one top panel for forming a top wall;

a base panel for forming a base wall;

a pair of side panels for forming opposed side walls; and at least one end closure panel for forming an end wall at each end of the carton;

the at least one top panel having opposed side edges and opposed end edges, the at least one top panel having a handle structure comprising:

at least one hand aperture defined in the at least one top panel;

at least one primary fold line formed in the at least one top panel and extending from a region of the at least one hand aperture toward at least one of the corners of the at least one top panel;

a diagonal severance line formed in the at least one top panel inwardly of and spaced from the at least one corner for separating the at least one primary fold line from the at least one corner; and a first branch fold line extending from an intermediate point along the length of the at least one primary fold line and extending toward one of an adjacent end wall and an adjacent side wall.

According to a sixth aspect of the present disclosure there is provided a blank for forming a carton, the blank comprising a plurality of panels for forming walls of the carton, the blank including:

at least one top panel for forming a top wall;

a base panel for forming a base wall;

a first side panel for forming a first side wall, the first side panel hingedly connected to the at least one top panel by a first fold line; and a first end closure panel for forming an end wall, the first end closure panel hingedly connected to the at least one top panel by a second fold line;

the top wall is adapted to be placed over a plurality of generally cylindrical articles such that the top wall is disposed generally perpendicularly to the cylindrical axes of the articles, the top wall having opposed side edges and opposed end edges, wherein the at least one top panel comprises a handle structure, the handle structure comprising:

at least one hand aperture defined in the at least one top panel;

at least one primary fold line formed in the at least one top panel and extending from an end region of the at least one hand aperture toward at least one of the corners of the at least one top panel; and a diagonal severance line formed in the at least one top panel inwardly of and spaced from the at least one corner for separating the at least one primary fold line from the at least one corner, wherein the diagonal severance line intersects with at least one of first and second fold lines at at least one intersection, wherein the distance between the at least one intersection and the at least one corner may be in the range given by the following formula:

$$\frac{Dc(\sqrt{2}-1)}{\sqrt{2}} < D \leq Dc$$

where $D_C$ is a diameter of each cylindrical article.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the disclosure can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
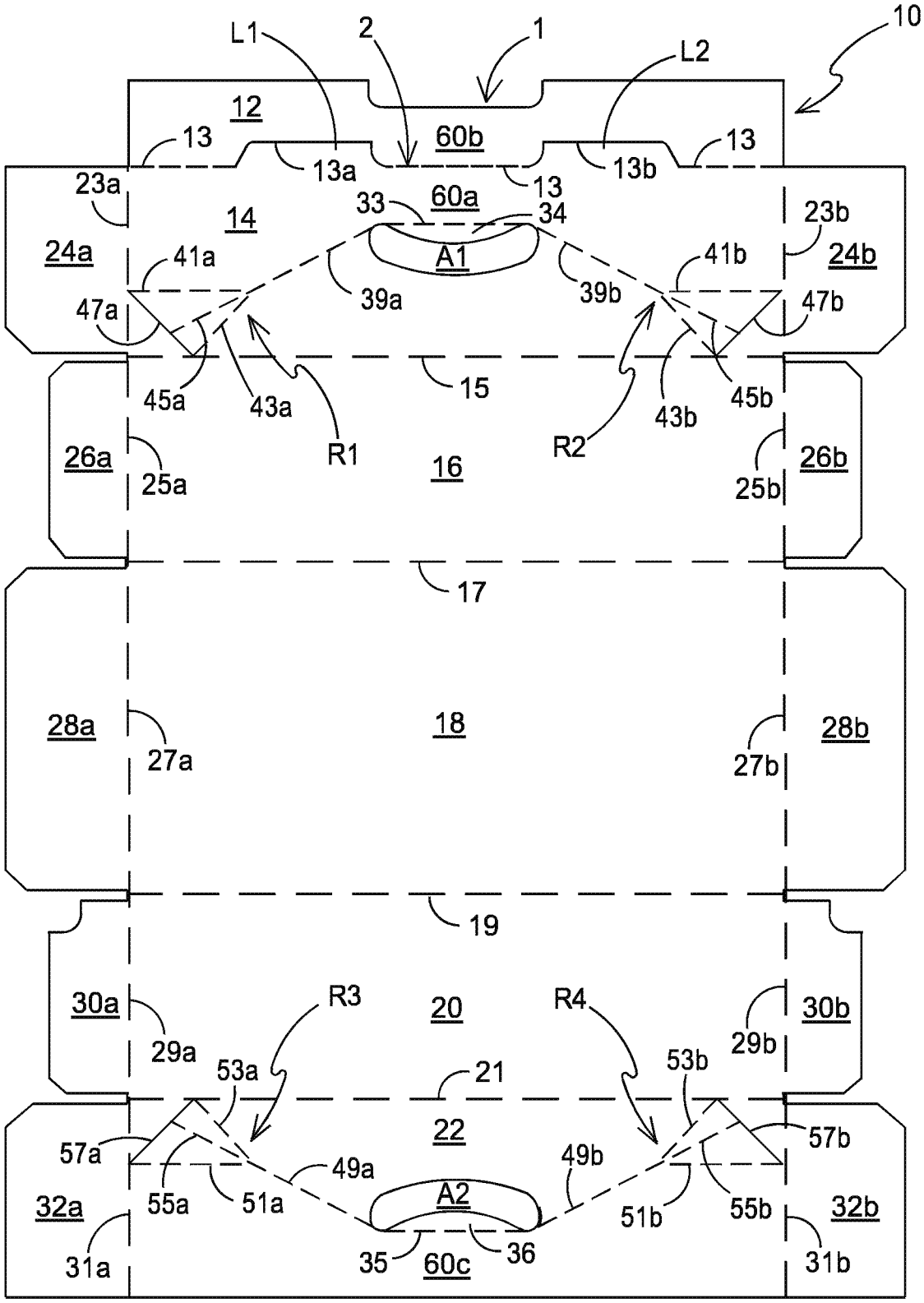
FIG. 1 is a plan view from above of a blank for forming a carton according to a first embodiment.
Figure 4:
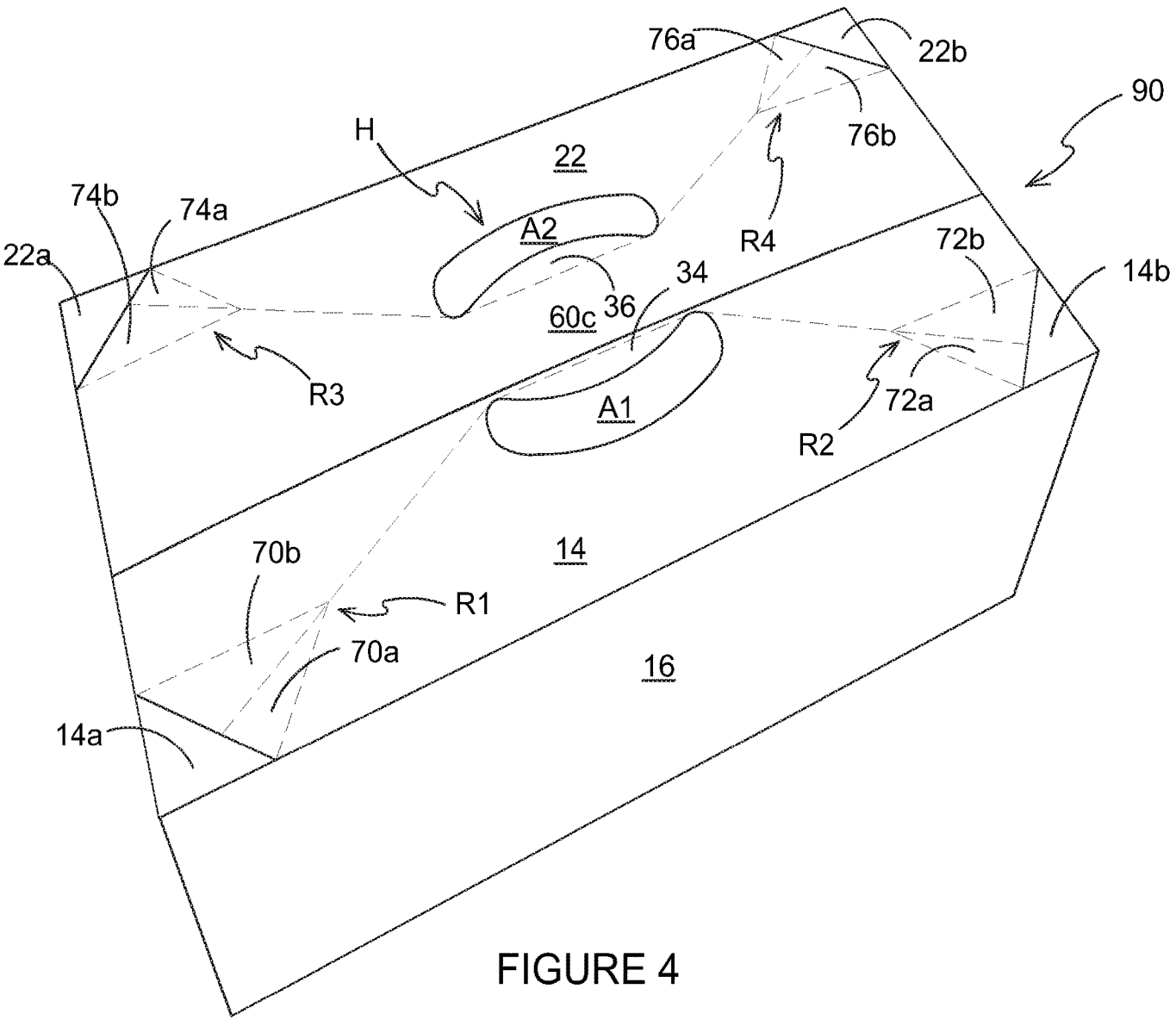
FIG. 4 is a perspective view from above of a carton formed from the blank of FIG. 1.

Referring to FIG. 1, there is shown a plan view of a blank 10 capable of forming a carton 90, as shown in FIG. 4, for primary products such as, but not limited to, cans or bottles, hereinafter referred to as articles.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blank 10 is configured to form a carton or carrier for packaging an exemplary arrangement of exemplary articles. In a first illustrated exemplary embodiment, the arrangement is a 3×6 matrix or array and the articles are 12 US fl.oz. (approx. 355 ml) cans. The blank 10 can be alternatively configured to form a carrier for packaging other types, number and size of article and/or for packaging articles in a different arrangement or configuration.

The blank 10 comprises a plurality of main panels 12, 14, 16, 18, 20, 22 hinged one to the next in a linear series. The blank 10 comprises a first top panel 14 hinged to first side panel 16 by a fold line 15. The first side panel 16 is hinged to a base panel 18 by a fold line 17. The base panel 18 is hinged to a second side panel 20 by a fold line 19. The second side panel 20 is hinged to a second top panel 22 by a fold line 21. A handle reinforcing panel 12 is hinged to the first top panel 12 by a fold line 13.

The plurality of main panels 12, 14, 16, 18, 20, 22 of the blank 10 form an open ended tubular structure in a set-up condition.

Each of the ends of the tubular structure is at least partially closed by end closure panels. In the illustrated embodiment the ends of the tubular structure are fully closed by end closure panels 24*a*, 26*a*, 28*a*, 30*a*, 32*a*, 24*b*, 26*b*, 28*b*, 30*b*, 32*b*.

End closure panels 24*a*, 26*a*, 28*a*, 30*a*, 32*a*, are configured to close a first end of the tubular structure and end panels 24*b*, 26*b*, 28*b*, 30*b*, 32*b*, are configured to close a second end of the tubular structure.

A first end closure panel 24*a* is hinged to a first end of first top panel 14 by a fold line 23*a*. A second end closure panel 26*a* is hinged to a first end of first side panel 16 by a fold line 25*a*. A third end closure panel 28*a* is hinged to a first end of base panel 18 by a fold line 27*a*. A fourth end closure panel 30*a* is hinged to a first end of the second side panel 20 by a fold line 29*a*. A fifth end closure panel 32*a* is hinged to a first end of second top panel 22 by fold line 31*a*.

A sixth end closure panel 24*b* is hinged to a second end of first top panel 14 by a fold line 23*b*. A seventh end closure panel 26*b* is hinged to a second end of the first side panel 16 by a fold line 25*b*. An eighth end closure panel 28*b* is hinged to a second end of base panel 18 by a fold line 27*b*. A ninth end closure panel 30*b* is hinged to a second end of second side panel 20 by a fold line 29*b*. A tenth end closure panel 32*b* is hinged to a second end of second top panel 22 by a fold line 31*b*.

The first end closure panel 24*a* along with the fifth end closure panel 32*a* forms a major upper end closure panel. The third end closure panel 28*a* forms a major lower end closure panel. The second end closure panel 26*a* and the fourth end closure panel 30*a* each form a minor side end closure panel or dust flap.

The sixth end closure panel 24*b* along with the tenth end closure panel 32*b* together form a major upper end closure panel. The eighth end closure panel 28*b* forms a major lower end closure panel. The seventh end closure panel 26*b* and the ninth end closure panel 30*b* each form a minor side end closure panel or dust flap.

The blank 10 comprises a handle structure for forming a carrying handle H, see FIG. 4.

A handle opening is provided by a first handle aperture Al struck from the first top panel 14. The first handle aperture A1 extends longitudinally, with respect to the tubular axis of the carton 90.

The first top panel 14 comprises first tab 34 forming a cushioning flap. The first tab 34 is hinged to the first top panel 14 by a fold line 33. The first tab 34 defines a portion of the edge or perimeter of the first handle aperture A1.

A further handle opening is provided by a second handle aperture A2 struck from the second top panel 22. The second handle aperture A2 extends longitudinally, with respect to the tubular axis of the carton 90.

The second top panel 22 comprises second tab 36 forming a cushioning flap. The second tab 36 is hinged to the second top panel 22 by a fold line 35. The second tab 36 defines a portion of the edge or perimeter of the second handle aperture A2.

The first handle aperture A1 and the second handle aperture A2 form part of a carrying handle H in a set-up carton 90 as shown in FIG. 4.

The first tab 34 and/ or the second tab 36 may, in some embodiments, close or seal the handle openings prior to deployment or first use of the carrying handle H.

The blank 10 comprises a cutaway defining a first recess 1 struck from a free side edge of the handle reinforcing panel 12. The first recess 1 is shaped complementary to a portion of the first handle aperture A1.

The fold line 13 hinging the first top panel 14 to the handle reinforcing panel 12 is interrupted by a first cutline 13*a* and by a second cutline 13*b*. The first cutline 13*a* is longitudinally spaced apart from the second cutline 13*b* such that a portion of the fold line 13 is provided therebetween.

The first cutline 13*a* extends into the handle reinforcing panel 12 so as to define a first projection or lobe L1.

The second cutline 13*b* extends into the handle reinforcing panel 12 so as to define a second projection or lobe L2.

The first and second lobes L1, L2 are struck from material which would otherwise form part of the handle reinforcing panel 12.

The first and second lobes L1, L2 are integrally formed with the first top panel 14.

A second recess 2 is defined between the first and second lobes L1, L2 when the handle reinforcing panel 12 is folded, about the fold line 13, into face contacting relationship with the first top panel 14. The second recess 2 is shaped complementary to a portion of the second handle aperture A2.

The first top panel 14 comprises a first handle grip portion 60*a*; the first handle grip portion 60*a* is defined in part by the fold line 33 and in part by the fold line 13 proximate the second recess 2. The second top panel 22 comprises a second handle grip portion 60*c*; the second handle grip portion 60*c* is defined in part by the fold line 35. The handle reinforcing panel 12 comprises a third handle grip portion 60*b*, the third handle grip portion 60*b* is defined in part by the first recess 1 in part the second recess 2. In the illustrated embodiments the the first, second and third handle grip portion 60*a*, 60*c*, 60*b* are centrally disposed with the handle structure H, in other embodiments the first, second and third handle grip portions 60*a*, 60*c*, 60*b* may be offset from the centre.

The blank 10 comprises a plurality of folding structures R1, R2, R3, R4 which form part of the handle structure H. Each folding structure R1, R2, R3, R4 comprises four fold lines and a weakened line of severance or cutline. The folding structures R1, R2, R3, R4 predefine preferred locations at which the top panel 14/22 folds when the carrying handle H is employed. Each of the folding structures R1, R2, R3, R4 forms a relief device or structure which controls or directs the load forces applied to the carton 90 when the carrying handle H is employed.

A first pair of folding structures R1, R2 defines a first side edge of a carrying handle. The first pair of folding structures R1, R2 comprises a first folding structure R1 extending towards or into a first corner of the first top panel 14 and a second folding structure R2 extending towards or into a second corner of the first top panel 14. The first corner of the first top panel 12 is defined by a vertex formed by the intersection of fold line 23*a* and fold line 15. The second corner of the first top panel 14 is defined by a vertex formed by the intersection of fold line 23*b* and fold line 15.

A second pair of folding structures R3, R4 defines a second side edge of the carrying handle. The second pair of folding structures R3, R4 comprises a third folding structure R3 extending towards or into a third corner of the second top panel 22 and a fourth folding structure R4 extending towards or into a fourth corner of the second top panel 22. The third corner of the second top panel 22 is defined by fold line 31*a* and fold line 21. The fourth corner of the second top panel 22 is defined by fold line 31*b* and fold line 21.

Each of the folding structures R1, R2, R3, R4 is substantially the same in construction and will be described in detail by reference to a second folding structure R2 disposed in the first top panel 14.

The folding structure R2 comprises a first fold line 39*b*. First fold line 39*b* extends from an end edge of the first handle aperture A1, adjacent to a terminal end of the fold line 33, towards an end edge of the first top panel 14 defined by the fold line 23*b*.

First fold line 39*b* forks or branches into three fold lines 41*b*, 43*b*, 45*b* each of which terminate at a cutline or severance line 47*b*.

A second fold line 45*b* may be arranged substantially collinearly with the first fold line 39*b*, the first and second fold line may form a primary fold line 39*b*/45*b* extending from the first handle aperture Al towards a corner of the first top panel 14, defined by the vertex of fold line 23*b* and fold line 15. The primary fold line 39*b*/45*b* may extend up to the cutline line 47*b*.

The first and second fold lines 39*b*, 45*b* may be arranged so as to lie upon a notional line N3 extending between the end edge of the first handle aperture A1, defined by terminal end of the fold line 33, and the corner of the first top panel 14, defined by the vertex of fold line 23*b* and fold line 15.

A third fold line 43*b* extends from the first fold line 39*b* to intersect the fold line 15 between the first top panel 14 and the first side panel 16. The third fold line 43*b* branches away from the primary fold line 39*b*/45*b*, so as to form a branch fold line 43*b*. The branch fold line 43*b* and the primary fold line 39*b*/45*b* define a first angle therebetween.

A fourth fold line 41*b* extends from the first fold line 39*b* to intersect the fold line 23*b* between the first top panel 14 and the sixth end closure panel 24*b*. The fourth fold line 41*b* branches away from the primary fold line 39*b*/45*b*, so as to form a further branch fold line 41*b*. The further branch fold line 41*b* and the primary fold line 39*b*/45*b* define a second angle therebetween. The second angle is different to the first angle such that the branch fold lines 43*b*, 41*b* are asymmetrically arranged with respect to the primary fold line 39*b*/45*b*.

The primary fold line 39*b*/45*b* may be at least 50% longer in length than the branch line 43*b*. The primary fold line 39*b*/45*b* may be at least 50% longer in length than the further branch line 41*b*.

The primary fold line 39*b*/45*b* may be at least twice the length of the branch line 43*b*. The primary fold line 39*b*/45*b* may be at least twice the length of the further branch line 41*b*.

The outline or severance line 47*b* extends between the fold line 23*b* (between the first top panel 14 and the sixth end closure panel 24*b*) and the fold line 15 (between the first top panel 14 and the first side panel 16).

The severance line 47*b* intersects the fold line 23*b* at the point P1 where the fourth fold line 41*b* meets the fold line 23*b*.

The severance line 47*b* intersects the fold line 15 at the point P2 where the third fold line 43*b* meets the fold line 15.

The fourth fold line 41*b* may be arranged to be substantially parallel to the fold line 15 between the top panel 14 and the first side panel 16.

The fourth fold line 41*b* may be arranged to be substantially perpendicular to the fold line 23*b* between the top panel 14 and the sixth end closure panel 24*b*.

In the illustrated embodiment, the third fold line 43*b* terminates at the fold line 15, in alternative embodiments the third fold line 43*b* may extend into the side panel 16. In the illustrated embodiment, the fourth fold line 41*b* terminates at the fold line 23*b*, in alternative embodiments the fourth fold line 41*b* may extend into the sixth end closure panel 24*b*.

Figure 2:
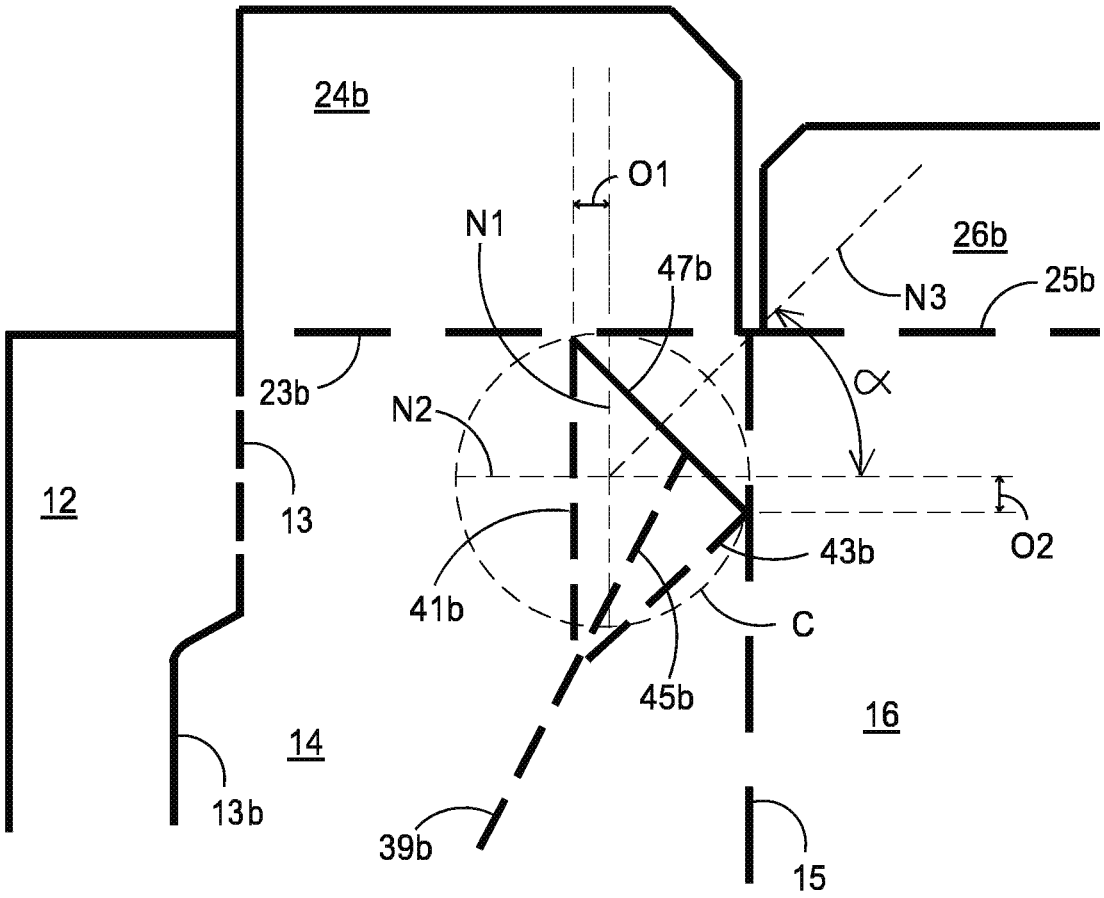
FIGS. 2 and 3 are enlarged plan views from above of a portion of the blank of FIG. 1.
Figure 3:
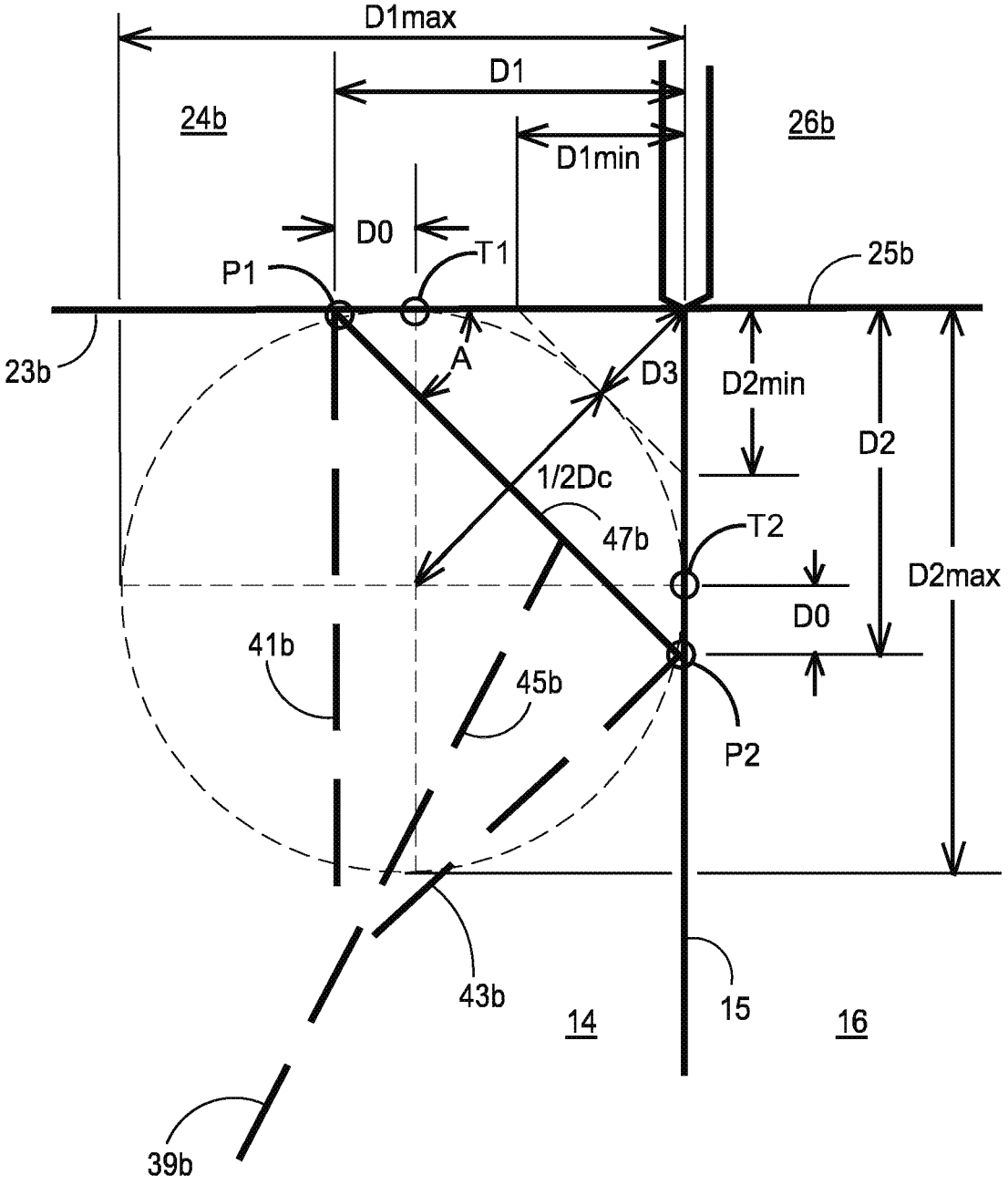

Referring now to FIGS. 2 and 3, there is shown a corner region of the first top panel 14. The position of an article C is shown. The article C comprises a substantially circular cross-sectional shape. The article C may comprise a tubular portion having a substantially cylindrical shape. The article C comprises a diameter Dc. The side wall of the tubular portion disposed in contact with, or at least close proximity to, a side wall formed by the first side panel 16 and an end wall formed at least in part by the sixth end closure panel 24*b*.

The side wall of the article C is illustrated in touching contact with each of the fold lines 23*b*, 15 in FIGS. 2 and 3.

The side wall of the article C is illustrated touching the fold line 23*b* at a first contact point T1, the location at which notional line N1 meets the fold line 23*b*. The side wall of the article C is illustrated touching the fold line 15 at a second contact point T2, the location at which notional line N2 meets the fold line 23*b*.

The cutline 47*b* together with a portion of the fold line 23*b* and a portion of the fold line 15 define an isosceles right triangle, a right triangle with the two legs (and their corresponding angles) equal.

The cutline 47*b* intersects the fold line 23*b* at a first end at a point P1. The point P1 is offset, away from the vertex defined by the intersection of fold line 23*b* and fold line 15, from the first contact point T1 by a distance D0.

Point P1 is located at linear distance D1 from the vertex defined by the intersection of fold line 23*b* and fold line 15.

The cutline 47*b* intersects the fold line 15 at a second end at a point P2. The point P2 is offset, away from the vertex defined by the intersection of fold line 23*b* and fold line 15, from the second contact point T2 by a distance D0.

Point P2 is located at linear distance D2 from the vertex defined by the intersection of fold line 23*b* and fold line 15.

It has been found that the relief structures R1, R2, R3, R4 provide greater relief and/or provide improved transfer of stress or load forces to the carton contents when the distance D1 is greater than a minimum value D1*min* and when the distance D2 is greater than a minimum value D2*min*. D1*min* and D2*min* are given by equation (1) below:

$$D1\min = D2\min = \frac{D3}{\sin 45} \tag{1}$$

Where D3 is the minimum distance between the side wall of the article C and the corner of the top panel 16, defined by the vertex of fold line 23 and fold line 15. Distance D3 is given by equations (3) and (4) below:

$$D3 = 1/2\left(\sqrt{2}\,Dc - Dc\right) \tag{2}$$

$$D3 = \frac{Dc\left(\sqrt{2} - 1\right)}{2} \tag{3}$$

since:

$$\sin 45 = \frac{\sqrt{2}}{2} \tag{4}$$

The minimum distances D1*min*, D2*min* are given by equation (5):

$$D1\min = D2\min = \frac{\sqrt{2}\,D3}{2} \tag{5}$$

Substituting equation (3) into equation (5) gives the minimum distances D1*min*, D2*min* as a function of article diameter Dc:

$$D1\min = D2\min = \frac{Dc\left(\sqrt{2} - 1\right)}{\sqrt{2}} \tag{6}$$

It has been found that the relief structures R1, R2, R3, R4 provide greater relief and/or provide improved transfer of stress or load forces to the carton contents when the distance D1 is equal to or less than a maximum value D1*max* and when the distance D2 is equal to or less than a maximum value D2*max*.

In this way, a range of values for D1 and D2 are given by equations (7), (8) below:

$$D1\min < D1 \le D1\max \tag{7}$$

$$D2\min < D2 \le D2\max \tag{8}$$

The value of D1 and/or D2 is given by the range given in equations (9), (10) respectively:

$$\frac{Dc\left(\sqrt{2} - 1\right)}{\sqrt{2}} < D1 \le Dc \tag{9}$$

$$\frac{Dc\left(\sqrt{2} - 1\right)}{\sqrt{2}} < D2 \le Dc \tag{10}$$

In some embodiments, it is desirable for D1 and/or D2 to lie in the range defined by equations (11), (12) below:

$$\frac{Dc}{2} \leq D1 \leq Dc \tag{11}$$

$$\frac{Dc}{2} \leq D2 \leq Dc \tag{12}$$

where $D_c/2$=R=radius of the article C.

In the illustrated embodiment, the point P1 where the outline 47*b* intersects the fold line 23*b* is located at a distance D1 from the corner of the top panel 16, defined by the vertex of fold line 23 and fold line 15. The distance is D1 is equal to the sum of the radius of the article and an offset distance D0, equation (13) below:

$$D1 = \frac{Dc}{2} + D0 \tag{13}$$

In this way, the point P1 is offset a distance D0 from the contact point of the article C with the end wall of the carton 90, defined in part by sixth end closure panel 24*b*.

In the illustrated embodiment, the point P1 is located a distance D0 further from the corner of the top panel 16 (defined by the vertex of fold line 23 and fold line 15) than the contact point of the article C with the end wall of the carton 90.

In alternative embodiments, the point P1 is located a distance D0 closer to the corner of the top panel 16 (defined by the vertex of fold line 23 and fold line 15) than the contact point of the article C with the end wall of the carton 90. In such embodiments distance D1 may be defined by equation (14):

$$D1 = \frac{Dc}{2} - D0 \tag{14}$$

In some embodiments, the distance D0 may be in the range ⅛" (approx. 3.2 mm) to ¾" (approx. 19 mm) and optionally may be equal to ¼" (approx. 6.4 mm).

In the illustrated embodiment, the article C is a can having a capacity of 12 US fl. oz. or 355 ml. The can is 4.83 inches (approx. 122 mm) high, 2.13 inches (approx. 54 mm) in diameter at the lid, and 2.60 inches (approx. 66 mm) in diameter at the widest point of the body, FIGS. 2 and 3 illustrate the widest diameter. In this way, the offset distance D0 is approximately one tenth (0.097) of the widest diameter Dc of the can.

The ratio of the offset distance D0 to the can diameter Dc may fall in the range 0.07 to 0.13, and optionally in the range 0.07 to 0.1.

In the illustrated embodiment, the point P2 where the cutline 47*b* intersects the fold line 15 is located at a distance D2 from the corner of the top panel 16, defined by the vertex of fold line 23 and fold line 15. The distance is D2 is equal to the sum of the radius of the article and an offset distance D0, equation (15) below:

$$D2 = \frac{Dc}{2} + D0 \tag{15}$$

In this way, the point P2 is offset a distance D0 from the contact point of the article C with the side wall of the carton 90, defined by side panel 16.

In the illustrated embodiment, the point P2 is located a distance D0 further from the corner of the top panel 16 (defined by the vertex of fold line 23 and fold line 15) than the contact point of the article C with the side wall of the carton 90.

In alternative embodiments, the point P2 is located a distance D0 closer to the corner of the top panel 16 (defined by the vertex of fold line 23 and fold line 15) than the contact point of the article C with the side wall of the carton 90. In such embodiments distance D2 may be defined by equation (14):

$$D2 = \frac{Dc}{2} - D0 \tag{16}$$

In some embodiments, the distance D0 may be in the range ⅛" (approx. 3.2 mm) to ¾" (approx. 19 mm) and optionally may be equal to ¼" (approx. 6.4 mm).

In the illustrated embodiment, the article C is a can having a capacity of 12 US fl. oz. or 355 ml. The can is 4.83 inches (approx. 122 mm) high, 2.13 inches (approx. 54 mm) in diameter at the lid, and 2.60 inches (approx. 66 mm) in diameter at the widest point of the body, FIGS. 2 and 3 illustrate the widest diameter. In this way, the offset distance D0 is approximately one tenth (0.097) of the widest diameter Dc of the can.

The ratio of the offset distance D0 to the can diameter Dc may fall in the range 0.07 to 0.13, optionally in the range 0.07 to 0.1.

The offset distance D0 employed for each of distances D1 and D2 may be different, or may be equal as illustrated.

In the illustrated embodiment, the cutline 47*b* and the fold line 23*b* define an angle A therebetween. The angle A may be in the range given by equation (17) below:

$$16° \leq A \leq 74° \tag{17}$$

In the illustrated embodiment, the angle A is 45 degrees.

In the illustrated embodiment, the first fold line 39*b* is substantially longer in length than the second fold line 45*b*, the first fold line 39*b* may be at least 40% greater in length than the second fold line 45*b*, optionally around 45% longer.

The cut line 47*b* crosses or overlies a notional line N3 between the centre of the article C and the corner of the top panel 16 defined by the vertex of the fold lines 23*b*, 15. The notional line N3 extends from the corner of the top panel 16 at an angle of 45° to the fold line 23*b*.

The location at which the cut line 47*b* crosses or overlies the notional line N3 lies between the centre of the article C and notional intersection between the notional line N3 and the edge or perimeter of the article C.

The location at which the cut line 47*b* crosses or overlies the notional line N3 is therefore located at a distance equal to or greater than D3. The location at which the cut line 47*b* crosses or overlies the notional line N3 is therefore located at a distance equal to or less than Dc/2+D3.

Referring again to FIG. 2, there is an illustrated relief structure R2 which is asymmetrical in shape, relief structures R1, R3, R4 are substantially similar albeit mirror images of relief structure R2.

The fourth fold line 41*b*, third fold line 43*b* and cutline 47*b* define a triangle. The triangle comprises an apex which intersects the first fold line 39*b*. The apex is closer to fold line 15 than to fold line 23*b*.

The fourth fold line 41*b* is longer in length than the third fold line 43*b*.

The fourth fold line 41*b*, second fold line 45*b* and a first portion of cutline 47*b* define a first relief panel 72*b*, the first relief panel 72*b* is triangular in shape.

The third fold line 43*b*, second fold line 45*b* and a second portion of cutline 47*b* define a second relief panel 72*a*, the second relief panel 72*a* is triangular in shape.

The second relief panel 72*a* may comprise a smaller area dimension than the first relief panel 72*b*. In other embodiments, the first relief panel 72*b* may comprise a smaller area dimension than the second relief panel 72*a*.

The cutline 47*b* may comprise one or more severable nick portions which prior to separation effectively interrupt the cutline 47*b* coupling first and//or second relief panels 72*b*, 72*a* to the corner portion 14*b*.

The cutline 47*b* may comprise a severable nick portion between a first end and the fold line 23*b*. The cutline 47*b* may comprise a severable nick portion between a second end and the fold line 15.

The cutline 47*b* may extend into the first side panel 16, in such embodiments the cutline 47*b* may comprises a tear prevention element for inhibiting tearing of the side panel 16. For example, but not limited to, the cutline may terminate with a "J" shaped cut or other arcuate line, or may terminate with an aperture or cutaway such as a circular or oval aperture.

The cutline 47*b* may extend into the sixth end closure panel 24*b*, in such embodiments the cutline 47*b* may comprises a tear prevention element for inhibiting tearing of the side panel 16. For example, but not limited to, the cutline may terminate with a "J" shaped cut or other arcuate line, or may terminate with an aperture or cutaway such as a circular or oval aperture.

The cutline 47*b* in the illustrated embodiments is linear, however in alternative embodiments the cutline 47*b* may be arcuate or curvilinear in shape. In such embodiments, the ends of the cutline may intersect with the fold lines 23*b*, 15 at locations falling within the ranges described above.

In some embodiments the cutline 47*b* may comprise a two or more cut lines or severable lines, for example the cutline 47*b* may take the form of a pair of opposed arcuate severance lines, such that a first one of the pair of opposed arcuate severance lines may be convex when viewed from the corner of the top panel 16, defined by the vertex of fold lines 23*b*, 15. A second one of the pair of opposed arcuate severance lines is concave when viewed from said corner of the top panel 16.

The cutline 47*b* may be provided in the form of a cutaway such as an aperture, for example, but not limited to, a slot or a slit or an oval shaped aperture.

Under the above conditions, when the carrying handle H is in use the carton 90 (see FIG. 5) is pinched inwardly at each of the four of corners of the top panel 16. The cutlines 47*a*, 47*b*, 57*a*, 57*b* define edges of corner portions 14*a*, 14*b*, 22*a*, 22*b*. The articles when engaged may be moved, encouraged or forced towards the centre of the carton 90. In turn the engaged articles may be tightened, moved towards or transfer force or load into adjacently disposed articles.

The carton 90 may grip or engage a rim, edge or chime of an article C the carton 90 may grip the article C at the points P1, P2.

The arrangement may be advantageous in that it eliminates or at least reduces the likelihood of side walls or end walls or both the side and end walls to deform, fold or collapse when the carrying handle is in use.

Figure 5:
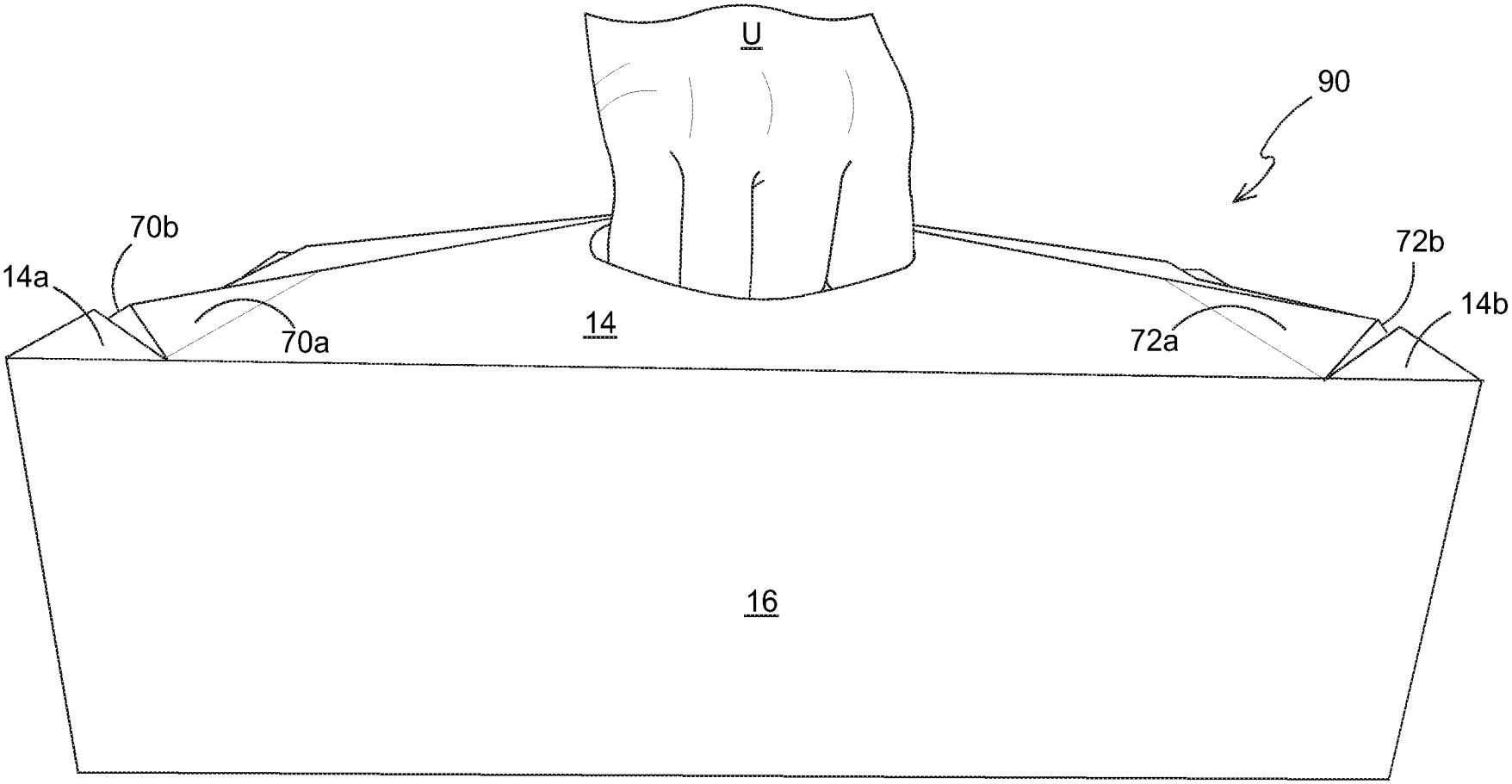
FIG. 5 is a further perspective view of the carton of FIG. 1 showing a carrying handle in use.

Turning to the construction of the carton 90 as illustrated in FIGS. 4 and 5, the carton 90 can be formed by a series of sequential folding operations in a straight line machine so that the carton 90 is not required to be rotated or inverted to complete its construction. The folding process is not limited to that described below and may be altered according to particular manufacturing requirements.

Glue or other adhesive treatment is applied to the handle reinforcing panel 12 or, in alternative embodiments, to a corresponding portion of the first top panel 14.

The blank 10 is folded about fold line 13 such that the handle reinforcing panel 12 is brought into face contacting relationship with an inside surface of the first top panel 14. The handle reinforcing panel 12 is secured to the first top panel 12.

The blank 10 is folded about fold line 15, such that the first top panel 14 is folded thereabouts. The first top panel 14 is folded such that an inside surface is brought into face contacting relationship with an inside surface of the first side panel 16.

Glue or other adhesive treatment is applied to an outer surface of the first top panel 14 or, in alternative embodiments, to a corresponding portion of an inner surface of the second top panel 22.

Glue or other adhesive treatment is applied to an outer surface of each of the first and sixth end closure panels 24*a*, 24*b* or, in alternative embodiments, to corresponding portions of an inner surface each of the fifth and tenth end closure panels 32*a*, 32*b*.

The second top panel 22 and the second side panel 20 are folded about the fold line 19 such that the second top panel 22 at least partially overlaps with the first top panel 14.

The second top panel 22 is secured to the first top panel 14, to form a composite top panel 14/22, in this way a flat collapsed carton is formed. The carton 90 may be shipped or distributed in this flat collapsed form.

The first end closure panel 24*a* is secured in at least partially overlapping relationship to the fifth end closure panel 32*a*, to form a first composite top end closure flap 24*a*/32*a*.

The sixth end closure panel 24*b* is secured in at least partially overlapping relationship to the tenth end closure panel 32*b*, to form a second composite top end closure flap 24*b*/32*b*.

In alternative embodiments, the second top panel 22 may be secured to the first top panel 14 by alternative securing means for example, but not limited to, staples or other mechanical fixing means.

The flat collapsed carton may be erected into a tubular structure by separating the composite top panel 14/22 from the base panel 18.

The carton 90, in its open ended tubular form, may be loaded with articles through one or both open ends. It will be appreciated that in other embodiments one of the open ends of the carton 90 may be closed before loading the carton 90 with articles through the remaining open end.

In some embodiments, some or all of the end closure panels may be folded outwardly so as to create a funnel at the open end of the tubular structure for facilitating loading of the carton with articles.

Once the carton 90 is loaded with articles B the ends of the tubular structure are closed.

A first end of the tubular structure is closed by folding the second end closure panel 26*a* along with the fourth end closure panel 30*a*, the minor or side end closure flaps, about fold lines 25*a*, 29*a* respectively.

Glue or other adhesive treatment may be applied to the third end closure panel 28*a* or in alternative embodiments to corresponding portions of the second end closure panel 26*a* and the fourth end closure panel 30*a*.

The third end closure panel 28*a* is then folded about the fold line 27*a* to be brought into contact with the second and fourth end closure panels 26*a*, 30*a*.

Glue or other adhesive treatment is applied to an outer surface of the third end closure panel 28*a* or in alternative embodiments to a corresponding inner surface portion of the first composite top end closure flap 24*a*/32*a*.

The first composite top end closure flap 24*a*/32*a* is then folded about the fold lines 23*a*, 31*a* to be brought into contact with the third end closure panel 28*a*.

The first composite top end closure flap 24*a*/32*a* secured to the third end closure panel 28*a*.

A second end of the tubular structure is closed in similar manner to the method described herein above.

FIGS. 4 and 5 illustrate an assembled carton 90. FIG. 5 illustrates the carrying handle H in use by a user U. The contents of the carton 90, articles C, exert a load on the carton 90.

This results in an upward or outward deformation of the composite top panel 14/22 as can be seen in FIG. 5.

The user U inserts one or more fingers through at least one of the apertures A1, A2 and grasps the grasps or otherwise engages with a handle grip defined between the handle openings and provided by the first, second and third handle grip portions 60*a*, 60*c*, 60*b*.

The composite top panel 14/22 folds about fold lines 39*a*, 39*b*, 49*a*, 49*b*.

The composite top panel 14/22 folds about fold lines 41*a*, 43*a*, 45*a*, 41*b*, 43*b*, 45*b*, 51*a*, 53*a*, 55*a*, 51*b*, 53*b*, 55*b*.

In this way, the relief structures R1, R2, R3, R4 each form raised peaks defined by respective pairs of relief panels 70*a*/70*b*, 72*a*/72*b*, 74*a*/74*b*, 76*a*/76*b*.

The corner portion 14*a*, 14*b*, 22*a*, 22*b* may optionally bow or deform, optionally outwardly.

In this way, the carton 90 tightens or grips an article located in the corner of the carton this may encourage said corner article towards the center of the carton 90. This may in turn encourage articles adjacent to the corner article towards the center of the carton 90.

The side and end walls of the carton 90 may have the effect of squeezing the carton contents. The articles within the carton 90 may provide a brace between the opposed side walls and or between the opposed end walls of the carton 90.

The handle structure H and relief structures R1, R2, R3, R4 may be particularly advantageous when the contents of the carton exert high load forces upon the carrying handle.

The carton 90 of the illustrated embodiment comprises a side walls which are substantially longer than the end wall, thus the base panel is rectangular in shape. The side walls are around twice the length of the end walls of the carton 90. The handle structure H and relief structures R1, R2, R3, R4 may be advantageous when the side walls of the carton are 50% or greater in length than the end walls.

It can be appreciated that various changes may be made within the scope of the present invention. For example, the size and shape of the panels and apertures may be adjusted to accommodate articles of differing size or shape.

It will be recognized that as used herein, directional references such as "top", "bottom", "base", "front", "back", "end", "side", "inner, "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

As used herein, the term "nick portion" refers to a speck of the sheet material from which the respective carton blank is formed. The "nick portion" interrupts a cut or slit formed in the blank such that the material on one side of the cut or slit is joined or connected by the "nick portion" with the material on the other side of the cut or slit.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for receiving a plurality of articles, the carton comprising a plurality of panels for forming walls of the carton including:

a top wall;

a bottom wall;

a pair of side walls; and a pair of end walls;

the top wall having opposed side edges and opposed end edges, the top wall having a handle structure comprising:

at least one hand aperture defined in the top wall;

at least one primary fold line formed in the top wall and extending from a region of the at least one hand aperture toward at least one of the corners of the top wall;

a diagonal severance line formed in the top wall inwardly of and spaced from the at least one corner for separating the at least one primary fold line from the at least one corner; and a first branch fold line extending from an intermediate point along the length of the at least one primary fold line and extending toward one of an adjacent end wall and an adjacent side wall, wherein the intermediate point is located at a first distance from the at least one corner and a second distance from the at least one hand aperture, wherein (i) the first distance is less than the second distance, or (ii) the at least one primary fold is at least 50% longer in length than the first branch line, or (iii) both the first distance is less than the second distance and the at least one primary fold is at least 50% longer in length than the first branch line.

2. A carton according to claim 1 wherein the first branch fold line and the at least one primary fold line define a first angle therebetween.

3. A carton according to claim 2 wherein the handle structure comprises:

a second branch fold line extending from an intermediate point along the length of the at least one primary fold line and extending toward the other one of an adjacent end wall and an adjacent side wall.

4. A carton according to claim 3 wherein the second branch fold line and the at least one primary fold line define a second angle therebetween.

5. A carton according to claim 4 wherein the second angle is different to the first angle.

6. A carton according to claim 4 wherein the second angle is greater than the first angle.

7. A carton according to claim 4 wherein the second angle is less than the first angle.

8. A carton according to claim 3 wherein the second branch line and the diagonal severance line converge at a hinged connection between the top wall and said other one of an adjacent end wall and an adjacent side wall.

9. A carton according to claim 3 wherein the at least one primary fold is at least 50% longer in length than the second branch line.

10. A carton according to claim 3 wherein the at least one primary fold is at least twice the length of the second branch line.

11. A carton according to claim 1 wherein the first branch line and the diagonal severance line converge at a hinged connection between the top wall and said one of an adjacent end wall and an adjacent side wall.

12. A carton according to claim 1 wherein the at least one primary fold is at least twice the length of the first branch line.

13. A carton according to claim 1 wherein a distance D between the at least one intersection and the at least one corner is given by the following formula:

$$D=Dc+DO$$

where Dc is a diameter of each cylindrical article and DO is an offset distance, wherein the offset distance DO is in the range given by the formula:

$$0.07 \leq \frac{D0}{Dc} \leq 0.13.$$

14. A carton according to claim 13 wherein the offset distance DO is 0.25 inches (6.4 mm).

15. A carton according to claim 13 wherein the offset distance DO is less than or equal to 0.25 inches (6.4 mm).

16. A carton for receiving a plurality of articles, the carton comprising a plurality of panels for forming walls of the carton including:

a top wall;

a bottom wall;

a pair of side walls; and a pair of end walls;

the top wall having opposed side edges and opposed end edges, the top wall having a handle structure comprising:

at least one hand aperture defined in the top wall;

at least one primary fold line formed in the top wall and extending from a region of the at least one hand aperture toward at least one of the corners of the top wall;

a diagonal severance line formed in the top wall inwardly of and spaced from the at least one corner for separating the at least one primary fold line from the at least one corner; and a first branch fold line extending from an intermediate point along the length of the at least one primary fold line and extending toward one of an adjacent end wall and an adjacent side wall, wherein the at least one primary fold is at least 50% longer in length than the first branch line.

17. A carton for receiving a plurality of generally cylindrical articles, the carton comprising a plurality of panels for forming walls of the carton including:

at least one top panel for forming a top wall;

at least one base panel for forming a base wall;

a first side panel for forming a first side wall, the first side panel hingedly connected to the at least one top panel by a first fold line; and a first end closure panel for forming an end wall, the first end closure panel hingedly connected to the at least one top panel by a second fold line;

the top wall is adapted to be placed over the plurality of generally cylindrical articles such that the top wall is disposed generally perpendicularly to the cylindrical axes of the articles, the top wall having opposed side edges and opposed end edges, the top wall comprising a handle structure, the handle structure comprising:

at least one hand aperture defined in the top wall;

at least one primary fold line formed in the top wall and extending from a region of the at least one hand aperture toward at least one of the corners of the top wall; and a diagonal severance line formed in the top wall inwardly of and spaced from the at least one corner for separating the at least one primary fold line from the at least one corner, wherein the diagonal severance line intersects with at least one of first and second fold lines to form at least one intersection, wherein the distance between the at least one intersection and the at least one corner is in the range given by the following formula:

$$\frac{Dc(\sqrt{2}-1)}{\sqrt{2}} < D \leq Dc$$

where Dc is a diameter of each cylindrical article.

18. A carton according to claim 17 wherein the diagonal severance line intersects with both the first and second fold lines to form first and second intersections, wherein the distance D between each intersection and the at least one corner is given by the following formula:

$$\frac{Dc(\sqrt{2}-1)}{\sqrt{2}} < D \leq Dc$$

where Dc is a diameter of each cylindrical article.

19. A carton according to claim 18 wherein the angle defined between the second fold line and the severance line is greater than 16 degrees and less than 74 degrees.

20. A blank for forming a carton, the blank comprising a plurality of panels for forming walls of the carton, the blank including:

at least one top panel for forming a top wall;

a base panel for forming a base wall;

a pair of side panels for forming opposed side walls; and at least one end closure panel for forming an end wall at each end of the carton;

the at least one top panel having opposed side edges and opposed end edges, the at least one top panel having a handle structure comprising:

at least one hand aperture defined in the at least one top panel;

at least one primary fold line formed in the at least one top panel and extending from a region of the at least one hand aperture toward at least one of the corners of the at least one top panel;

a diagonal severance line formed in the at least one top panel inwardly of and spaced from the at least one corner for separating the at least one primary fold line from the at least one corner; and a first branch fold line extending from an intermediate point along the length of the at least one primary fold line and extending toward one of an adjacent end wall and an adjacent side wall, wherein the intermediate point is located at a first distance from the at least one corner and a second distance from the at least one hand aperture, wherein (i) the first distance is less than the second distance, or (ii) the at least one primary fold is at least 50% longer in length than the first branch line, or (iii) both the first distance is less than the second distance and the at least one primary fold is at least 50% longer in length than the first branch line.

* * * * *